US005360138A

United States Patent [19]

Zeller

[11] Patent Number: 5,360,138

[45] Date of Patent: Nov. 1, 1994

[54] DISPENSING SYSTEM SUITABLE FOR USE IN DISPENSING FOOD FOR HUMAN CONSUMPTION AND METHOD OF USE

[76] Inventor: Charles W. Zeller, Box 103, Bartley, Nebr. 69020

[21] Appl. No.: 106,845

[22] Filed: Aug. 16, 1993

[51] Int. Cl.[5] ..... B67B 7/00

[52] U.S. Cl. ..... 222/1; 119/53; 222/168; 222/172; 222/185; 222/390

[58] Field of Search ..... 222/1, 160, 167, 168, 222/169, 172, 185, 390; 119/52.1, 52.2, 52.3, 53

[56] References Cited

U.S. PATENT DOCUMENTS

| | | | |
|---|---|---|---|
| Re. 9,585 | 2/1881 | King | 222/390 |
| 2,789,534 | 4/1957 | Landgraf | 119/52.2 X |
| 2,796,848 | 6/1957 | Zimmerman | 119/53 |
| 2,884,899 | 5/1959 | Jackes et al. | 119/53 |
| 2,941,506 | 6/1960 | Fulton | 119/53 |
| 3,083,687 | 4/1963 | Slaven | 119/51 |
| 3,085,718 | 4/1963 | Nelson | 222/168 |
| 3,136,296 | 6/1964 | Luin | 119/52.2 |
| 4,433,641 | 2/1984 | Waite | 119/53 |

FOREIGN PATENT DOCUMENTS

| | | | |
|---|---|---|---|
| 93491 | 5/1962 | Denmark . | |
| 1155675 | 5/1958 | France | 222/390 |
| 2520192 | 7/1983 | France . | |
| 949121 | 8/1956 | Germany | 222/390 |
| 138455 | 3/1919 | United Kingdom | 119/53 |
| 935868 | 9/1963 | United Kingdom | 119/53 |
| 948716 | 2/1964 | United Kingdom | 119/52.2 |

OTHER PUBLICATIONS

Big Dutchman sd, 1971.

*Primary Examiner*—Andres Kashnikow
*Assistant Examiner*—Joseph A. Kaufman
*Attorney, Agent, or Firm*—James D. Welch

[57] ABSTRACT

A dispensing system of the type including an essentially horizontally oriented plate and an essentially vertically oriented hollow storage cylinder is disclosed. A distinguishing spindle and disc system is present inside said essentially vertically oriented hollow storage cylinder. The disc can serve to form chambers thereabove and therebelow within the essentially vertically oriented hollow storage cylinder. The dispensing system is easy to use, requiring only that a user lift the essentially vertically oriented hollow storage cylinder to dispense dispensable items contained therein onto the upper surface of the essentially horizontally oriented plate.

2 Claims, 1 Drawing Sheet

DISPENSING SYSTEM SUITABLE FOR USE IN DISPENSING FOOD FOR HUMAN CONSUMPTION AND METHOD OF USE

TECHNICAL FIELD

The present invention relates to dispensing systems and more particularly to a dispensing system comprised of an essentially horizontally oriented plate with an essentially vertically oriented hollow storage cylinder removably resting thereon, in which essentially vertically oriented hollow storage cylinder is present a spindle and disc system.

BACKGROUND

The benefits provided by plate and storage cylinder combination systems have been especially well demonstrated by Patents covering inventions in the area of animal feeders and small parts dispensers. While specific embodiments vary, said systems generally provide an essentially horizontally oriented plate which is located vertically below a lower end of an essentially vertically oriented hollow storage cylinder. During use, feed or small parts etc. stored in said essentially vertically oriented hollow storage cylinder can escape therefrom onto said essentially horizontally oriented plate for consumption or collection etc.

Most feeder systems provide that a lower end of an essentially vertically oriented hollow storage cylinder be fixed in relation to an upper surface of an essentially horizontally oriented plate. Said positioning being typically fixed to provide an intended gap length between the lower end of said essentially vertically oriented hollow storage cylinder and the upper surface of said essentially horizontally oriented plate, such that an optimum controlled flow of feed from said essentially vertically oriented hollow storage cylinder is achieved during use, in response to removal of feed present on said essentially horizontally oriented plate. See U.S. Pat. Nos. 4,433,641 to Waite; 2,941,506 to Fulton; 2,789,534 to Landgraf for instance, which describe such systems. Another U.S. Pat. No. 3,136,296 to Luin, describes a varied embodiment of a functionally similar system in which the lower end of an essentially vertically oriented hollow storage cylinder rests upon the upper surface of an essentially horizontally oriented plate. Holes are present in the lower end of the wall of the essentially vertically oriented hollow storage cylinder, however, through which feed can flow during use. In addition, a U.S. Pat. to Nelson, No. 3,085,718 describes a dispensing for small parts in which an essentially vertically oriented hollow storage cylinder is present in relation to an essentially horizontally oriented tray-like plate. The lower end of the essentially vertically oriented hollow storage cylinder is cut so that the wall thereof, on one side thereof, is longer than is the wall on an opposite side thereof. Operation of the Nelson system is by rotation of said essentially vertically oriented hollow storage cylinder so that the short wall thereof becomes oriented with respect to the essentially horizontally oriented tray-like plate so that a part can exit thereinto for collection. It is noted that other Patents, both U.S. and Foreign also describe functionally similar systems.

It should be appreciated that while a number of Patents, such as those surveyed above, describe feed or small part dispensing systems, no reference known to the inventor of the present invention teaches an easy to use dispensing system suitable for use in dispensing food for human consumption, such as nuts and jelly beans etc. The present invention provides an aesthetically attractive dispensing system for said use.

DISCLOSURE OF THE INVENTION

The present invention is an aesthetically attractive dispensing system suitable for use in dispensing nuts and jelly beans etc. for human consumption. The present invention is comprised of an essentially horizontally oriented plate, upon an upper surface of which removably rests a lower end of an essentially vertically oriented hollow storage cylinder. Within said essentially vertically oriented hollow cylinder is present a spindle, which spindle slidably projects through a hole through a disc, said disc being sized so that its outer edge preferably simultaneously slidable contacts an inner surface of said essentially vertically oriented hollow storage cylinder.

During use the disk is removed from said dispensing system and nuts or jelly beans etc. are caused to be entered into the space within the essentially vertically oriented hollow storage cylinder, while the lower end of said essentially vertically oriented storage cylinder removably rests on the upper surface of the essentially oriented plate. When the essentially vertically oriented hollow storage cylinder is sufficiently filled, said disk is entered to the system so that it typically rests atop the nuts or jelly beans etc. When it is then desired to dispense contained nuts or jelly beans etc. a user simple lifts the essentially vertically oriented hollow storage cylinder, so that its lower end raises above the upper surface of the essentially horizontally oriented plate, to cause release of an intended quantity of nuts or jelly beans etc. onto said upper surface of said essentially horizontally oriented plate. When an intended amount of nuts or jelly beans etc. have been so dispensed the user simply pushes down on the essentially vertically oriented hollow storage cylinder, while optionally providing a rotating or twisting motion thereto as well, so that its lower end thereof again removably rests atop the upper surface of the essentially horizontally oriented plate, thereby securing remaining nuts or jelly beans etc. therein for later release.

It should be appreciated that the disc can be of a weight which, pressing down on said nuts or jelly beans etc., aids the release of nuts or jelly beans etc. as just described. As well, it should be particularly noted that said disc serves to form two chambers inside said essentially vertically oriented hollow storage cylinder. When nuts with shells are present inside the present dispensing system, a user can place the shells removed from said nuts inside the chamber formed inside the essentially vertically oriented hollow storage cylinder which is above said disk. As more nuts are removed to the upper surface of the essentially horizontally oriented plate for consumption, by the method of use described above, the upper chamber will be increased in volume, thereby providing space to accommodate said shells.

It is also noted that multiple discs, or perhaps a disk of an elongated vertically oriented dimension can be used in the present invention when use of the chamber therein formed above the disc is not required, such as for instance when the present dispensing system is used to dispense jelly beans. It should be easily visualized that such might be of benefit when a disc decends into an essentially vertically oriented hollow storage cylinder as jelly beans etc. therein are removed. A relatively small vertical dimensioned disc located near the bottom of an essentially vertically oriented hollow storage cylinder, it will be appreciated, will not provide stability to said essentially vertically oriented hollow storage cylinder to the extent that is the case when said disc is located above jelly beans etc, at a vertically higher location inside said essentially vertically oriented hollow storage cylinder. Said stability, it will be appreciated, results when the spindle projects essentially vertically from, and is fixed to, the essentially horizontally oriented plate and said disc is positioned near the top of the essentially vertically oriented hollow storage cylinder. Also, in one embodiment of the present invention, a disc vertical travel stopping element can be present on the inner wall of said essentially vertically oriented hollow storage cylinder, or on the outer surface of said spindle to assure that the stability of the present dispensing system alluded to is maintained when nuts or jelly beans etc. are removed therefrom. In such an embodiment, said disc serves primarily as a cover for nuts or jelly beans etc. inside said essentially vertically oriented hollow storage cylinder, rather than as a weight to aid with dispensing of said nuts or jelly beans etc. It is noted that a vertical travel stopping element can be positioned to cause said disc to act primarily as a lid as well.

It should also be understood that the essentially vertically oriented hollow storage cylinder and spindle, as well as the essentially horizontally oriented plate can be of any functional design. That is, for instance, the term "cylinder" is not to be interpreted to necessarily identify an element with a constant circular cross section over the length thereof, or which has essentially linear walls. As well, the term "spindle" can be of various functional shapes, as can said essentially horizontally oriented plate. Likewise, the term disc is not to be interpreted to necessarily denote any specific shape. Any aesthetic design for the various elements of the present dispensing system, consistent with the function thereof, are within the scope of the present invention.

SUMMARY OF THE INVENTION

Various dispensing systems for dispensing feed and small parts etc. are known. Said dispensing systems are generally comprised of an essentially vertically oriented hollow storage cylinder and an essentially horizontally oriented plate combined so as to form a system which serves to release stored feed or small parts etc. onto said essentially horizontally oriented plate from said essentially vertically oriented hollow storage cylinder in response to removal of feed or small parts from said essentially horizontally oriented plate, or in response to specific user action.

An easy to use, aesthetic, dispensing system suitable for use in dispensing food for human consumption as disclosed herein, however, is not disclosed in any known reference. The present invention provides such a system.

The present invention is comprised of an essentially horizontally oriented plate upon which removably rests an essentially vertically oriented hollow storage cylinder, in which said essentially vertically oriented hollow storage cylinder is present a distinguishing spindle and disc system as described elsewhere in this Disclosure.

The present invention allows a user to easily dispense, for instance, nuts or jelly beans etc. stored in said essentially vertically oriented hollow storage cylinder, onto the upper surface of said essentially horizontally oriented plate by a simple lifting motion.

It is therefore a purpose of the present invention to teach a dispensing system suitable for use in dispensing food, such as nuts or jelly beans etc., for human consumption.

It is another purpose of the present invention to teach a dispensing system which is easy to use.

It is yet another purpose of the present invention to teach a dispensing system which is aesthetic in appearance.

It is yet another purpose of the present invention to teach a dispensing system which can be configured to provide two chambers. One chamber being formed below said disc, and the other thereabove within said essentially vertically oriented hollow storage cylinder.

DETAILED DESCRIPTION

Figure 1:
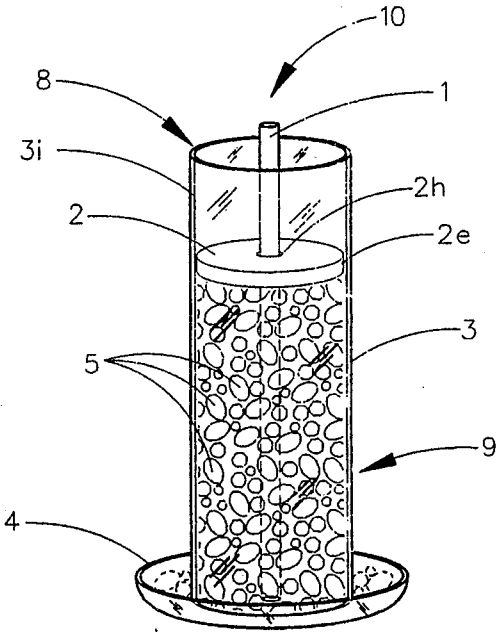
FIG. 1 shows one embodiment of the present dispensing system invention.

Turning now to the Drawings, there is shown in FIG. 1, one embodiment of the present invention (10). Shown are essentially horizontally oriented plate (4), with spindle (1) projecting essentially vertically therefrom. Note that disc (2) is shown with spindle (1) slidably projecting through a hole **(2*h*) therethrough. Also shown removably resting on essentially horizontally oriented plate (4) is essentially vertically oriented hollow storage cylinder (3), in which are present said spindle (1) and disk (2), as well as example nuts or jelly beans etc. (5). Note that disk (2) rests atop said example nuts or jelly beans etc. (5) and that the edge (2*e*) thereof slidably contacts the inner surface (3i) of said essentially vertically oriented hollow storage cylinder (3) simultaneous with said spindle (1) slidably projecting through hole (2*h*)** in said disc.

Figure 2:
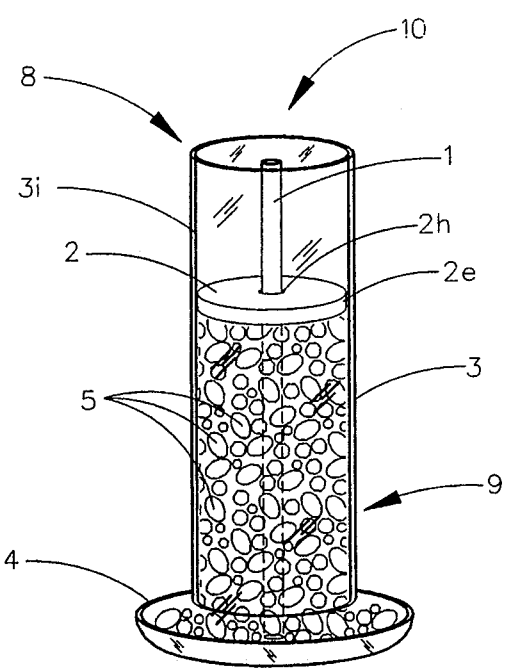
FIG. 2 shows the present dispensing system invention embodiment shown in FIG. 1 operated to a position in which nuts or jelly beans etc. contained therein are dispensed therefrom.

Turning now to FIG. 2 it is indicated that to dispense nuts or jelly beans etc. (5) from essentially vertically oriented hollow storage cylinder (3) onto the upper surface of essentially horizontally oriented plate (4), a user will simply lift essentially vertically oriented hollow storage cylinder (3) allowing said nuts or jelly beans etc. (5) to spill out, (dispense), from inside essentially vertically oriented hollow storage cylinder (3). While not shown in a separate Drawing, after a sufficient amount of nuts or jelly beans etc. (5) have been so dispensed, a user will reconfigure the dispensing system as shown in FIG. 1, but with dispensed nuts or jelly beans etc. still present and available for consumption on the upper surface of said essentially horizontally oriented plate (4). (Note that FIG. 1 shows nuts or jelly beans (5) in phantom view to demonstrate presence thereof outside essentially vertically oriented hollow storage cylinder (3) and atop the upper surface of essentially horizontally oriented plate (4)). Said reconfiguration is easily achieved by a user simply pushing essentially vertically oriented hollow storage cylinder (3) downward, perhaps combined with a rotation or twisting motion.

Also note that the dispensing system (10) is divided by disc (2) into two chambers (8) and (9). When nuts with shells are present inside essentially vertically oriented hollow storage cylinder (3), the shells can be placed into chamber (8) during use. Disk (2), it is noted, can be constructed of a heavy material to provide weight atop nuts or jelly beans etc. (5). Said weight can aid the dispensing said nuts or jelly beans etc.

Figure 3:
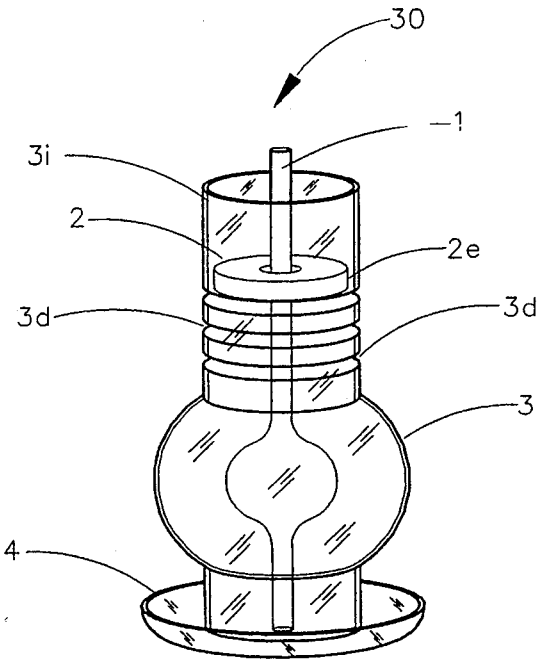
FIG. 3 shows a modified embodiment of the present dispensing system invention.

Turning now to FIG. 3, there is shown a modified embodiment of the present dispensing system (30) without any nuts or jelly beans etc. (5) therein. Note that essentially vertically oriented hollow storage cylinder (3) and spindle (1) are provided significantly different shapes as compared to the shapes shown in FIGS. 1 and 2. Also note that the outer edge (*2e*) of disc (2) does not slidably contact the inner edge (*3i*) of essentially vertically oriented hollow storage cylinder (3), but that disc (2) is prevented from sliding past vertical travel stopping means (*3d*) in the wall of said essentially vertically oriented hollow storage cylinder. Vertical travel stopping means (*3d*) could be located to effectively cause said disk to serve as a lid to essentially vertically oriented hollow storage cylinder (3). The differences between the dispensing systems shown in FIGS. 1 and 2 and that shown in FIG. 3 are arbitrary and primarily shown to exemplify that many aesthetic variations can be applied to the present invention. That is, elements of the embodiments in all the Figs. shown are within the scope of the present invention. Interchangability of elements shown in the various Figures is also possible. That is a disc such as shown in FIG. 3 could be used in the embodiment shown in FIGS. 1 and 2, for instance, and vice versa, and for instance, vertical travel stopping means (*3d*) could be present in the embodiment of FIGS. 1 and 2 etc. Functionally, the embodiments shown in FIGS. 1 and 2, and that shown in FIG. 3 are essentially equivalent for the purposes of this Disclosure. The presence of a spindle (1) and disc (2) serve to effect said identified function and distinguish the present invention.

Finally, it is mentioned that while nuts and jelly beans etc. were used as examples of dispensable items in this Disclosure, the present invention can be used to dispense any suitable item, whether suitable for human consumption, or otherwise. The term "dispensable items" is to be considered sufficiently broad to include all such suitable items. Also, while the drawings show the present dispenser system as being constructed from clear materials, it is to be understood that opaque materials can also be used in part or in whole.

Having hereby disclosed the subject matter of the present invention, it should be obvious that many modifications, substitutions, and variations of the present invention are possible in light of the teachings. It is therefore to be understood that the invention may be practiced other than as specifically described, and should be limited in breadth and scope only by the Claims.

I claim:

1. A method of dispensing dispensable items comprising the steps of:

a. obtaining a dispensing system of the type including an essentially horizontally oriented plate upon which removably rests, at its lower end, an essentially vertically oriented hollow storage cylinder, which dispensing system further comprises a spindle and disc system; said spindle projecting essentially vertically from said essentially horizontally oriented plate inside said essentially vertically oriented hollow storage cylinder and slidably projecting through a hole through said disc; such that during use dispensable items can be entered into said essentially vertically oriented hollow storage cylinder with said disc being placed thereabove, such that said dispensable items are released onto the upper surface of said essentially horizontally oriented plate by a user action of lifting said essentially vertically oriented storage cylinder;

b. removing said disc;

c. causing dispensable items to be entered into said essentially vertically oriented hollow storage cylinder;

d. placing said disk atop said dispensable items such that said spindle slidably projects through said hole therethrough;

e. lifting said essentially vertically oriented hollow storage cylinder upward such that dispensable items exit therefrom and accumulate upon the upper surface of said essentially horizontally oriented plate.

2. A method of dispensing dispensable items as in claim 1, which further comprises the step of:

pushing said essentially vertically oriented hollow storage cylinder downward, while optionally applying a rotation or twisting motion thereto, such that the lower end thereof again rests atop the upper surface of said essentially horizontally oriented plate, thereby securing remaining undispensed dispensable items therein.

* * * * *